United States Patent [19]

Nicoloff et al.

[11] 4,184,801

[45] Jan. 22, 1980

[54] DUAL LOADING AND STOWAGE APPARATUS

[75] Inventors: Nicholas Nicoloff, San Diego; Eugene B. Osuch, La Jolla, both of Calif.

[73] Assignee: The United States of America as represented by the Secretary of the Navy, Washington, D.C.

[21] Appl. No.: 916,413

[22] Filed: Jun. 16, 1978

[51] Int. Cl.[2] ..... B66F 7/02

[52] U.S. Cl. ..... 414/608; 114/238; 206/3; 244/137 R; 294/67 DA; 294/81 R; 294/87 R; 414/626; 414/745; 414/749

[58] Field of Search ..... 414/608, 626, 745, 749, 414/751, 403; 294/67 D, 67 DA, 81 R, 87 R; 206/3, 443; 89/1.5 R, 1.8; 244/137 R; 114/238, 239

[56] References Cited

U.S. PATENT DOCUMENTS

| | | | |
|---|---|---|---|
| 3,038,614 | 6/1962 | Morley | 414/518 X |
| 3,242,809 | 3/1966 | Bauer | 89/1.8 |

*Primary Examiner*—Stephen G. Kunin
*Assistant Examiner*—George F. Abraham
*Attorney, Agent, or Firm*—Richard S. Sciascia; Ervin F. Johnston

[57] ABSTRACT

A dual loading and stowage apparatus for handling a pair of cylindrical bodies, such as a pair of missiles, torpedoes, or projectiles. The apparatus includes an elongated base, and a pair of elongated trays which are positioned in tandem above the base and parallel thereto for receiving the cylindrical bodies. A device slidably mounts the trays for lateral movement on the base so that each tray can be selectively centered above the base for off-loading purposes. Each of the trays is pivoted to the mounting device along an inner edge so as to be capable of pivoting between downward and upward positions. The lateral dimension of the pair of trays in their downward positions is greater than the lateral dimension of the base, however, when one of the trays is pivoted to its upward position the lateral dimension of the trays is less than the lateral dimension of the base. With this arrangement, after unloading one of the cylindrical bodies from the apparatus, the unloaded tray can be pivoted upwardly and the loaded tray can be moved inwardly until the lateral space taken by the apparatus is minimized.

27 Claims, 32 Drawing Figures

FWD.
AFT
40
42
44
46
50
52
58
60
68
82
88
90
91
150
154
182
218
220
IV
V
VI
VII
X
XXI

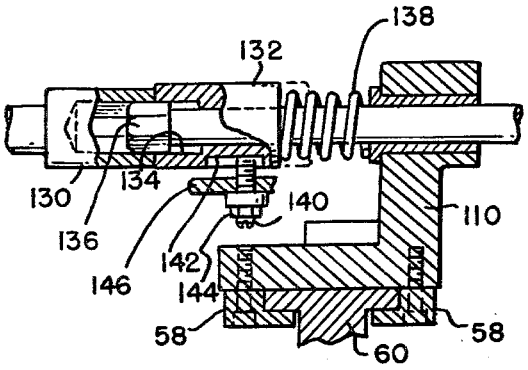
FIG. 17.
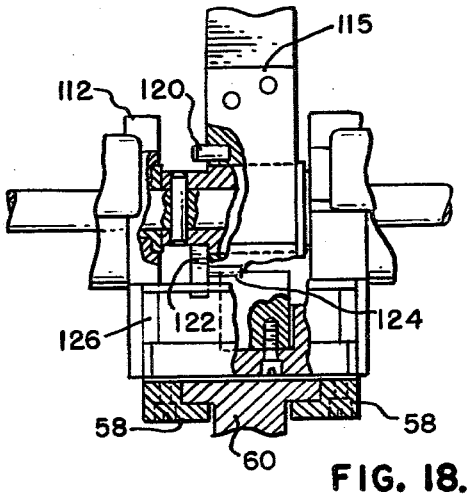
FIG. 18.
FIG. 20.
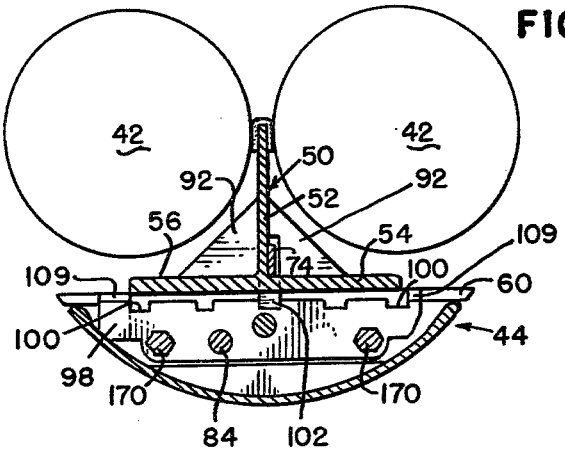
FIG. 19.
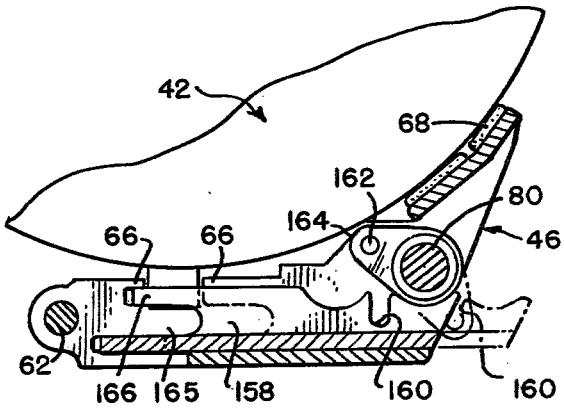
FIG. 21.
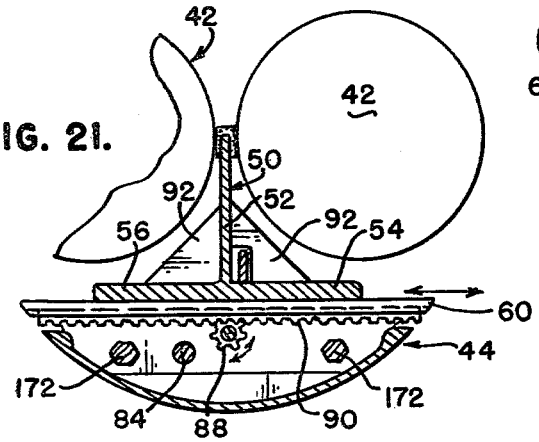

DUAL LOADING AND STOWAGE APPARATUS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to an apparatus for handling, stowing, and off-loading a pair of cylindrical bodies, such as a pair of missiles, torpedoes, or projectiles.

Submarine torpedo tubes are primarily utilized for launching torpedoes. However, other cylindrical objects, such as missiles, projectiles, or even oceanographic hardware, can be launched from a torpedo tube. A particular piece of hardware that the Navy is interested in launching from a torpedo tube is the mobile submarine simulator, hereinafter referred to as MOSS. In the past, a separate stowage tray was used to load and stow three of the MOSS. This tray utilized obsolete loading gear and special equipment was required to lock the MOSS to the gear aboard the submarine. In operation, the MOSS were manually removed from the tray utilizing emergency handling gear and then transferred to a MOSS loading tray. The loading tray was then indexed to the load line and the MOSS was loaded into the submarine launcher. This operation not only took a great deal of time, but was hazardous to personnel and involved three or four people. The equipment also took up extra storage space in the torpedo room which is very critical.

SUMMARY OF THE INVENTION

The present invention has provided an apparatus for handling, stowing, and off-loading a pair of cylindrical bodies into a torpedo tube aboard a submarine where space is at a premium. This has been accomplished by providing an elongated base, and a pair of elongated trays which are positioned in tandem above the base and parallel thereto for receiving the cylindrical bodies. A device slidably mounts the trays for lateral movement on the base so that each tray can be selectively centered above the base for off-loading purposes. Each of the trays is pivoted to the mounting device along an inner edge so as to be capable of pivoting between downward and upward positions. The lateral dimension of a pair of trays in their downward positions is greater than the lateral dimension of the base, however, when one of the trays is pivoted to its upward position the lateral dimension of the trays is less than the lateral dimension of the base. With this arrangement, after unloading one of the cylindrical bodies from the apparatus, the unloaded tray can be pivoted upwardly and the loaded tray can be moved inwardly until the lateral spaced taken by the apparatus is minimized.

OBJECTS OF THE INVENTION

An object of the present invention is to provide a single apparatus for handling, stowing, and off-loading a pair of cylindrical bodies within a minimum of space.

Another object is to provide a single apparatus for handling, stowing, and off-loading a pair of cylindrical in a torpedo room of a submarine.

A further object is to provide a single apparatus for handling, stowing, and off-loading a pair of cylindrical bodies wherein, after off-loading one of the cylindrical bodies from the apparatus, the apparatus can be folded to minimize the lateral space taken by the apparatus.

Still another object is to provide a single apparatus for handling, stowing, and off-loading a pair of cylindrical bodies wherein either cylindrical body can be laterally indexed to a load position, stow position, or an intermediate stow position which is between the load and stow positions within a minimum of space.

Still another object is to provide a single apparatus for handling, stowing, and off-loading a pair of cylindrical bodies with a minimum of space requirements and wherein controls for such operations as laterally indexing the bodies on the apparatus, releasing lashing of the bodies to the apparatus, releasing lashing of the apparatus to skids or dollies, and releasing longitudinal movement of the bodies on the apparatus, are locations substantially in a single plane for optimized operator convenience.

Yet another object is to provide a single apparatus which requires a minimum of space for handling, stowing, and off-loading a pair of cylindrical bodies and which can be operated by one person with a minimum of effort.

Still another object is to provide a single apparatus for handling, stowing, and off-loading a pair of cylindrical bodies in a minimum of space wherein the mechanisms and controls for accomplishing all of the functions are optimized in type and location for minimum space requirements and utilization.

Still another object is to utilize all existing shipping and handling procedures and equipment now used on all submarines to ship, and off ship. The apparatus aboard submarines, in transferring the apparatus within the submarines, fore, aft, and athwart ships, and also in loading of cylindrical bodies into the torpedo tubes.

Yet another object is to provide weight distribution within the apparatus which precludes rifling or tipping when shipping, off-shipping or transferring the apparatus within the submarine in all its configuration, i.e. apparatus with two cylindrical bodies (STOW position) apparatus with one cylindrical body (intermediate stow) and empty apparatus (STOW).

These and other objects of the invention will become more readily apparent from the ensuing specification when taken together with the drawings.

DESCRIPTION OF THE DRAWINGS

FIG. 17 is a cross-sectional view taken along plane XVII—XVII of FIG. 4.

FIG. 18 is a view taken along plane XVIII—XVIII of FIG. 7.

FIG. 19 is a cross-sectional view taken along plane XIX—XIX of FIG. 9.

FIG. 20 is a view taken along plane XX—XX of FIG. 3 with the strongback added thereto.

FIG. 21 is a cross-sectional view taken along plane XXI—XXI of FIG. 2.

DESCRIPTION OF THE PREFERRED EMBODIMENTS

Figure 1:
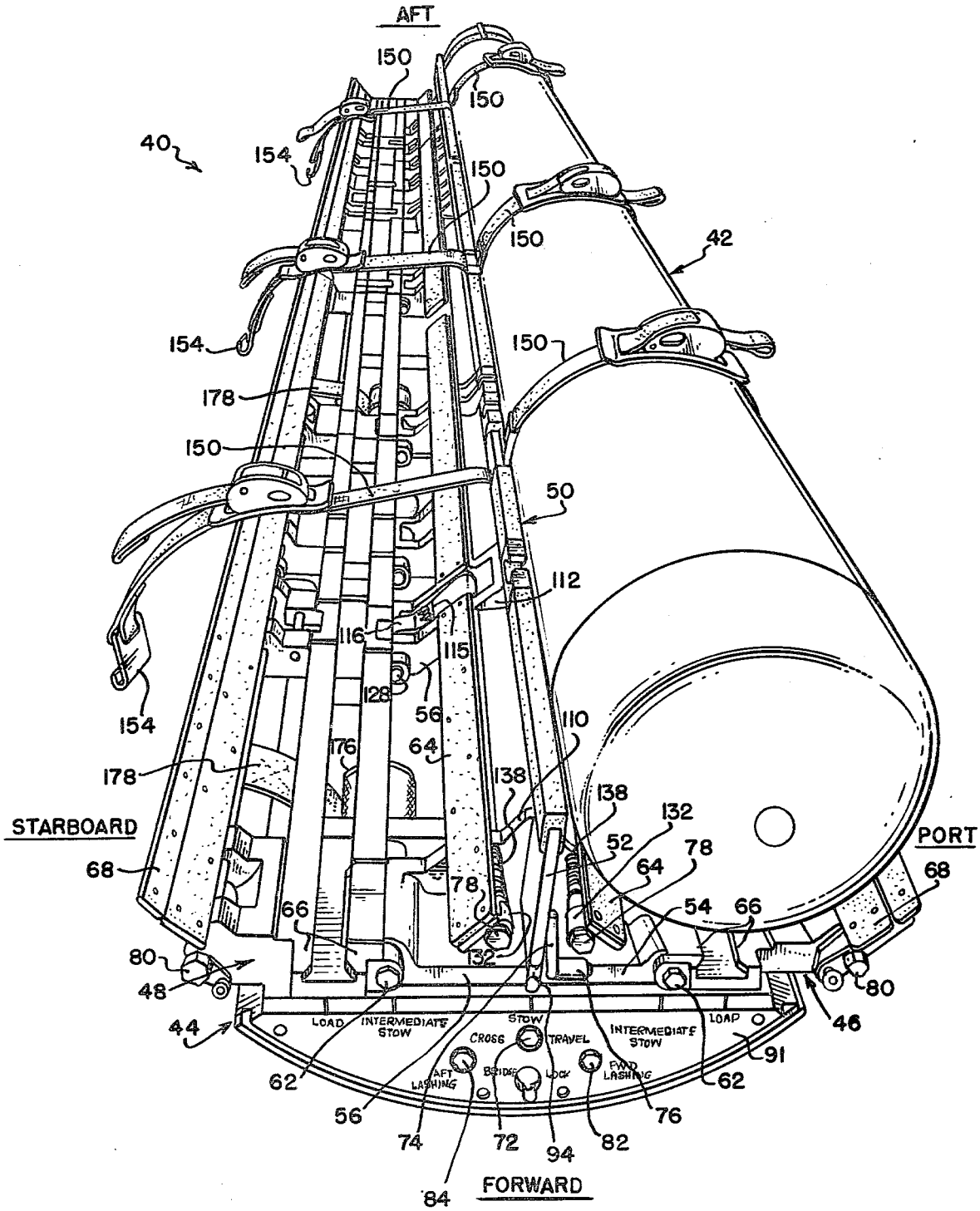
FIG. 1 is a perspective top view of the handling, stowing, and off-loading apparatus from the front with one of the cylindrical bodies loaded thereon.

Referring now to the drawings, wherein like reference numerals designate like or similar parts throughout the several views, there is illustrated in FIG. 1 a dual loading and a stowage apparatus 40 for handling, stowing, and off-loading a pair of cylindrical bodies, one of the cylindrical bodies 42 being loaded in place and the other cylindrical body being absent therefrom to show the various components of the apparatus. The dual loading and stowage apparatus 40 may include an elongated base 44 and a pair of identical pair of port and starboard elongated trays 46 and 48, respectively, the forward end of the apparatus being illustrated in the foreground of FIG. 1. The pair of trays 46 and 48 are positioned in tandem above the elongated base 44 and are parallel thereto for receiving the cylindrical bodies 42.

Figure 2:
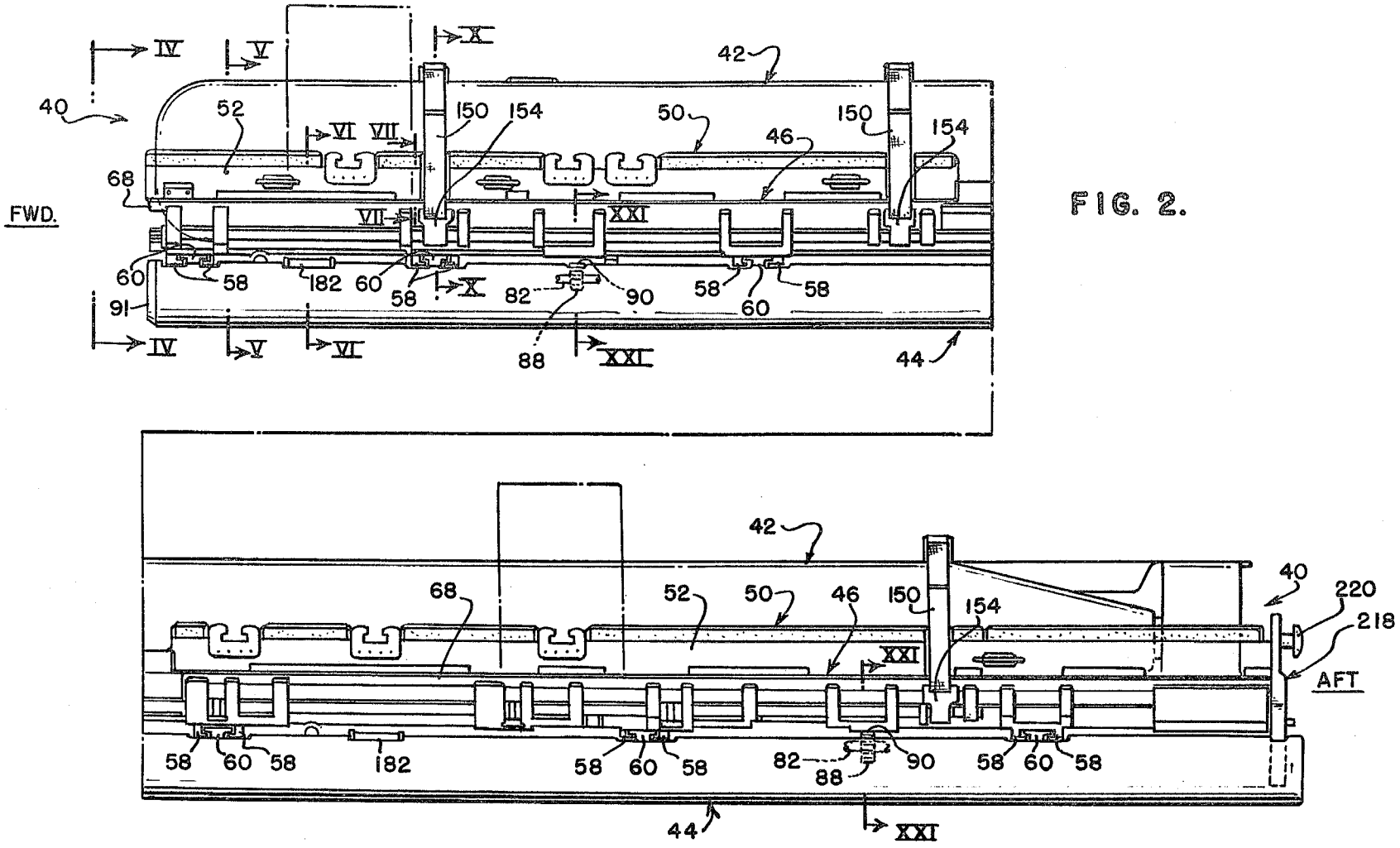
FIG. 2 is a longitudinal side view of the apparatus with one of the cylindrical bodies loaded thereon.
Figure 3:
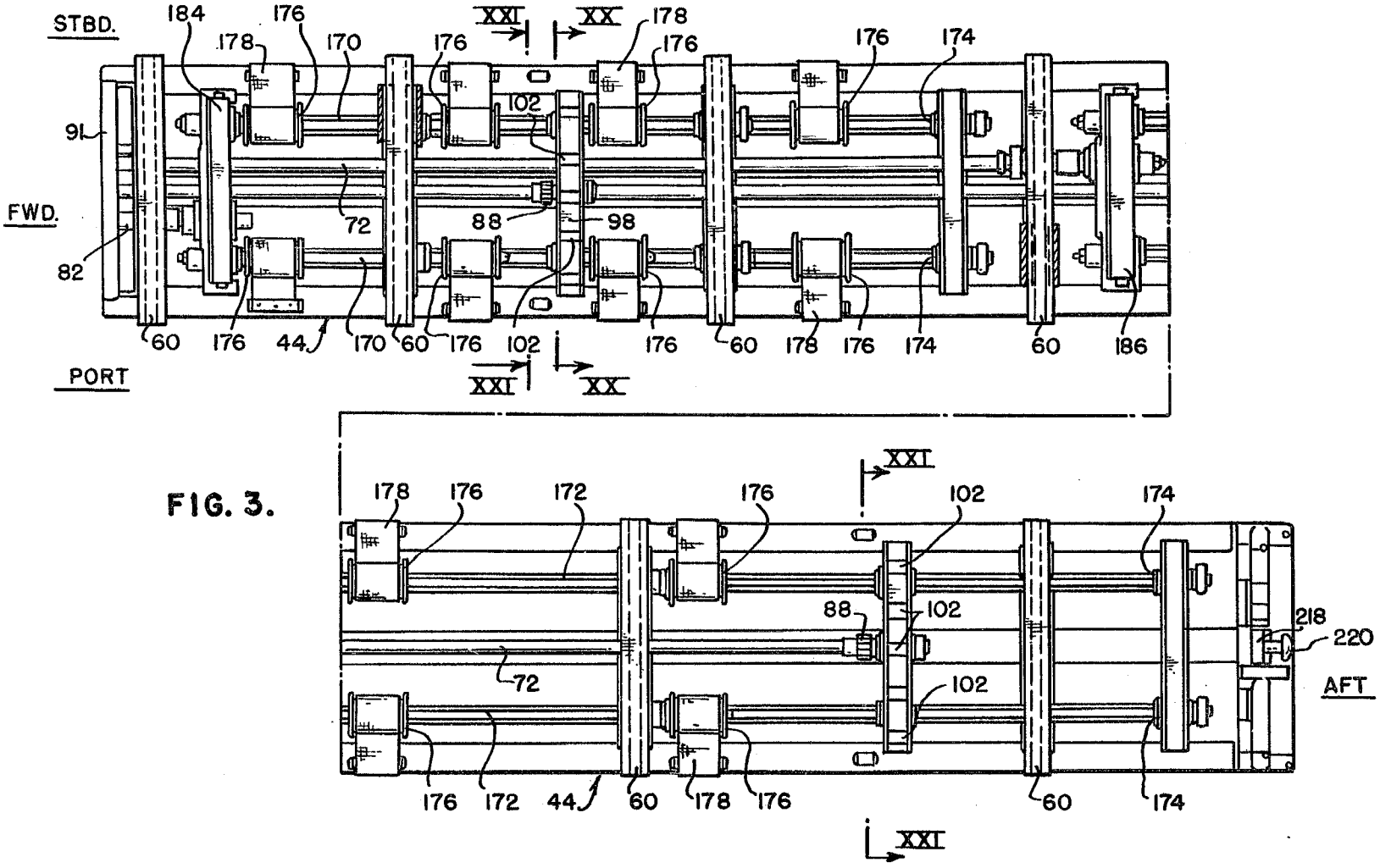
FIG. 3 is a top plan view of the base portion of the apparatus.
Figure 4:
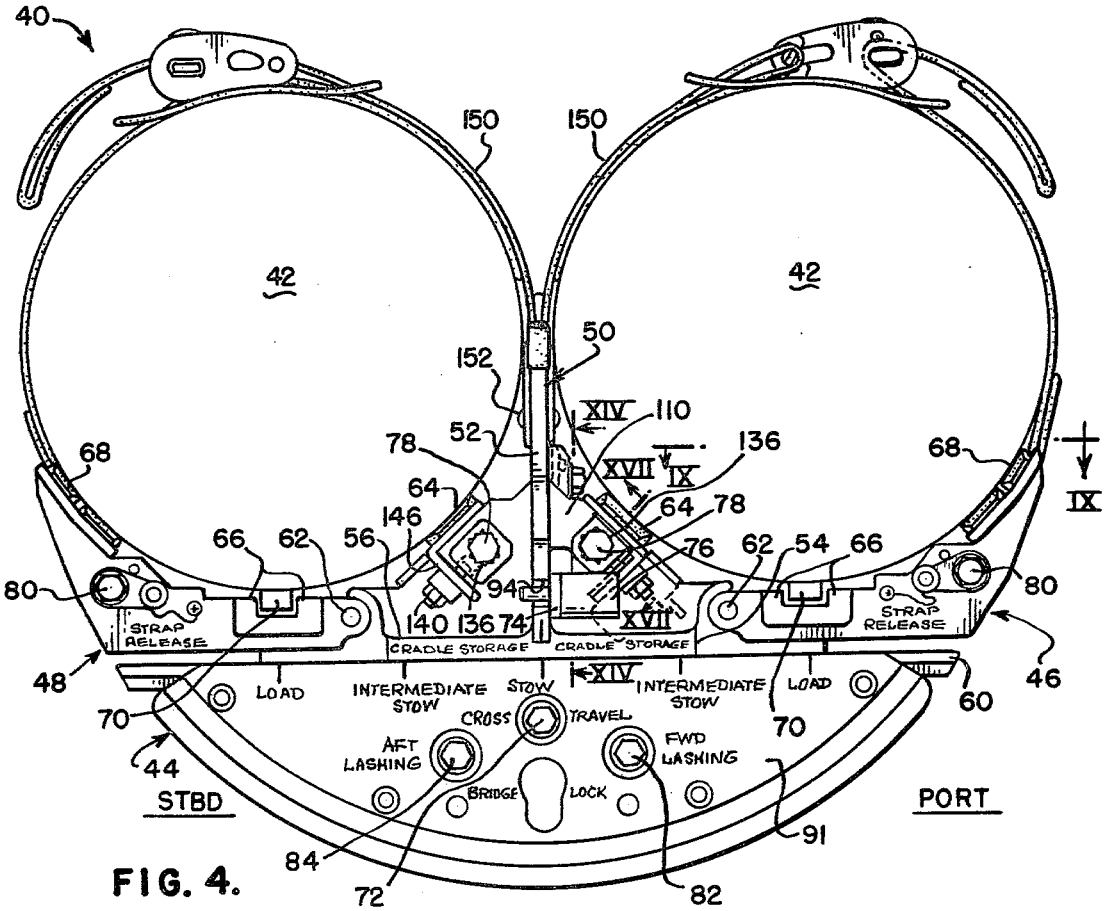
FIG. 4 is a view taken along plane IV—IV of FIG. 2 with both cylindrical bodies loaded thereon.
Figure 5:
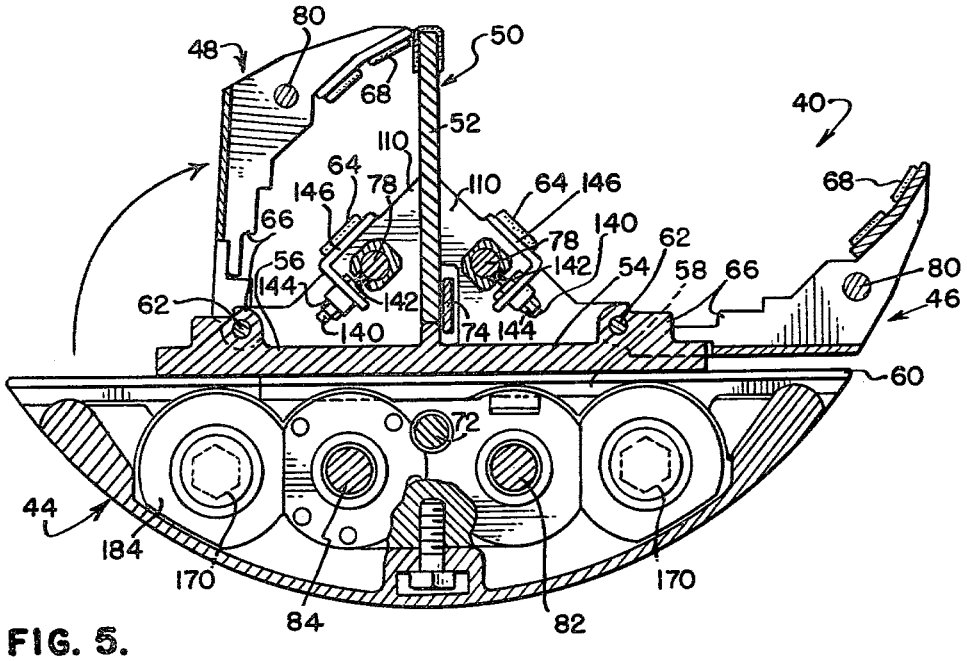
FIG. 5 is a cross-sectional view taken along plane V—V of FIG. 2 with the cylindrical bodies removed.
Figure 24:
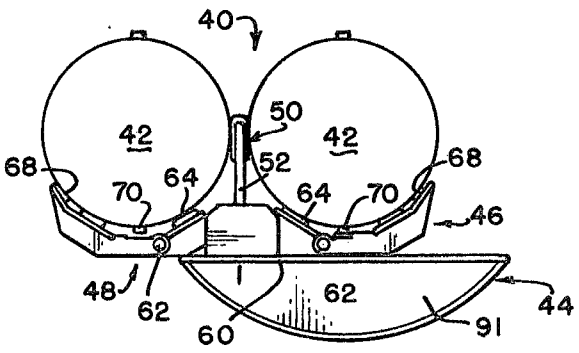
FIG. 24 is a schematic illustration of the apparatus with the cylindrical body on the right side in the load position.

Means are provided for slidably mounting the trays 46 and 48 for lateral movement on the base 44 so that each tray can be selectively centered above the base for off-loading purposes. This centered or load position is illustrated in FIG. 24 for the port cylindrical body 42. The trays can also be slid to an opposite position from that illustrated in FIG. 24 for centering the starboard cylindrical body over the base for off-loading purposes. The off-loading may occur aboard a submarine in a torpedo room where once either of the cylindrical bodies is centered it can be off-loaded into a torpedo tube for launching into the ocean waters. As illustrated in FIGS. 1, 4, and 5 the mounting means may include an elongated strongback 50 which is located parallel to and between the trays 46 and 48. The strongback 50 may include an elongated vertical member 52 and bottom laterally extending identical members 54 and 56 projecting from both sides thereof at spaced intervals along its length. As illustrated in FIGS. 2, 17, and 18 the laterally extending members 54 and 56 may be provided with laterally extending guides 58. As illustrated in FIGS. 2 through 5, 17, and 18 the mounting means may further include the base 44 being provided with laterally extending rails 60 upon which the guides 58 slide. With this arrangement the strongback 50 will slide the pair of trays 46 and 48 laterally on the base to various positions as illustrated in FIGS. 23 through 25.

Figure 25:
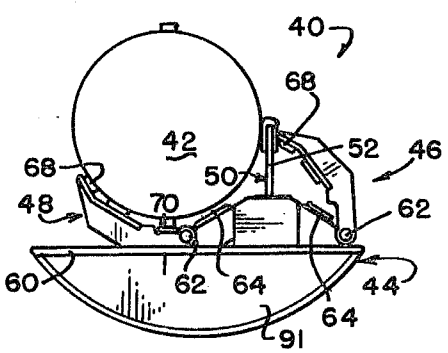
FIG. 25 is a schematic illustration of the apparatus with one of the cylindrical bodies in the intermediate stowed position after the other cylindrical body has been off-loaded.

Each of the trays 46 and 48 are pivoted to the strongback 50 along an inner edge of each respective tray so as to be capable of pivoting between downward and upward positions, both of these positions being illustrated schematically in FIG. 25. As illustrated in FIG. 1 the trays may be pivoted to the various lateral extensions 54 and 56 of the strongback by pins 62.

Figure 23:
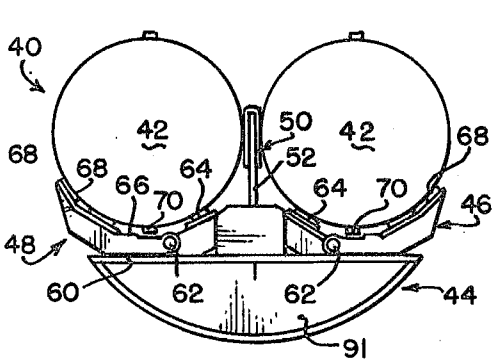
FIG. 23 is a schematic illustration of the apparatus in a position for storing a pair of the cylindrical bodies.

As illustrated in FIG. 23 the lateral dimension of the pair of trays 46 and 48 in their downward positions is greater than the lateral dimension of the base 44. However, when one of the trays is pivoted to its upward position, as illustrated in FIG. 25, the lateral dimension 50 and the trays 46 and 48 form a pair of cradles for receiving the cylindrical bodies, as best illustrated in FIGS. 1 and 4. The cradle configuration may be accomplished by providing the lateral strongback extensions 54 and 56 with upwardly angled rails 64, and providing each of the trays 46 and 48 with a pair of spaced apart horizontally oriented and longitudinally extending spaced apart rails 66 and an upwardly directed horizontally extending rail 68. As illustrated in FIG. 4, the weight of the cylindrical body is supported by the upwardly extending rails 64 and 68 so that the bottom of the cylindrical body is slightly spaced above the horizontally directed rails 66. It is also important to note from FIG. 4 that the cylindrical body 42 has a downwardly extending lug 70 which extends into the space between the horizontally directed rails 66 and will be guided thereby for purposes to be explained in detail hereinafter.

The dual loading and stowage apparatus 40 has fore and aft ends, the fore end being illustrated in detail in FIGS. 1 and 4. A plurality of the pair of trays is less than the lateral dimension of the base 44. With this arrangement, after unloading one of the cylindrical bodies from the dual loading and stowage apparatus 40, the unloaded tray can be pivoted upwardly, as illustrated in FIG. 25, and the loaded tray can be moved inwardly until the lateral space taken by the entire apparatus is minimized. The position of the trays illustrated in FIG. 25 is called the intermediate position. An indexing means for retaining the stow, load, and intermediate positions of FIGS. 23, 24, and 25 respectively will be described in detail hereinafter. It should also be noted from FIG. 25 that the vertical space taken up when one of the trays is folded to the upward position is minimized by having the outer lateral edge of the upwardly folded tray substantially meet the top edge of the upright member 52 of the strongback.

Figure 6:
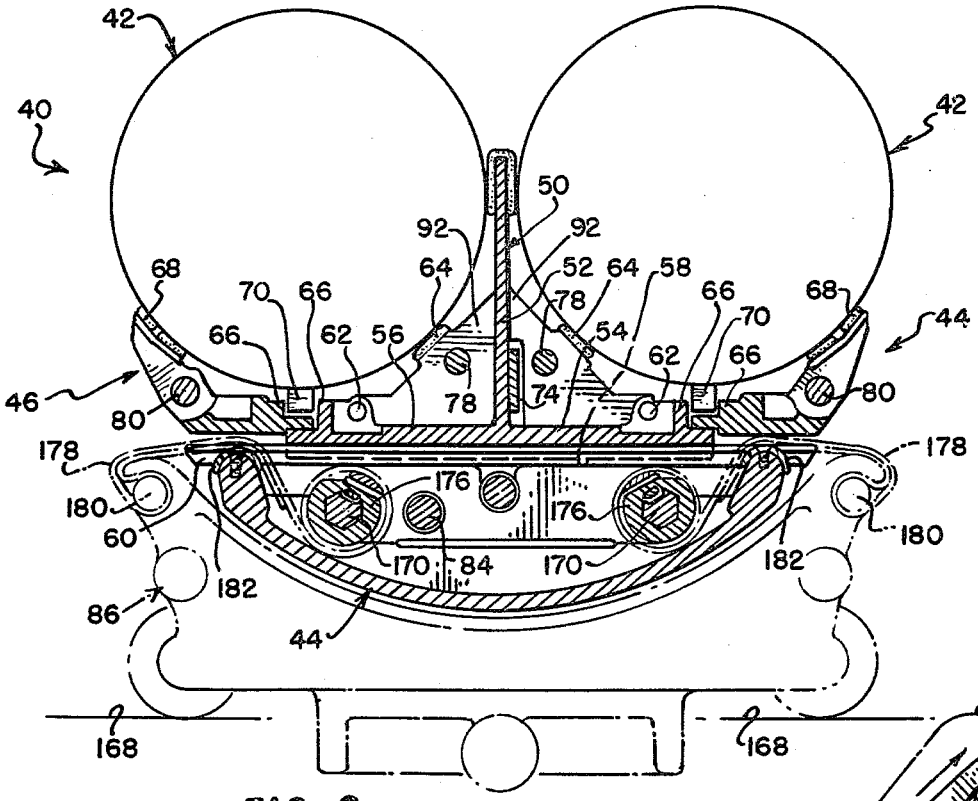
FIG. 6 is a cross-sectional view taken along plane VI—VI of FIG. 2 with both cylindrical bodies loaded thereon.

The minimum space features of the dual loading and stowage apparatus 40 are enhanced by the fact that the strongback of separable operable means are provided for moving respective components of the apparatus and, as illustrated in FIGS. 1 and 4, these operable means substantially terminate in controllable ends at a common transverse plane which is substantially coextensive with the fore end of the apparatus. The operable means may comprise shafts or rods which extend parallel to the base 44 and the trays 46 and 48. It is the termination of these shafts at the common transverse plane that will provide the various controllable ends. As illustrated in FIGS. 1 and 4, each controllable end may be provided with a nut so that the shafts can be turned by a wrench. The various control shafts will be listed and their general function will be set forth in tabular form:

(1) A cross travel shaft 72 is provided for laterally driving the strongback 50 to the port or to the starboard across the base 44 to the various positions, stow, intermediate stow, or load as aligned with the vertical member 52 of the strongback;

(2) an indexing rod 74 with a handle 76 is provided for indexing the strongback 50 to the various lateral positions across the base 44 as set forth in (1) above;

(3) a pair of identical tray locking shafts 78 for locking each respective tray 46 and 48 in its upward position, as schematically illustrated in FIG. 25;

(4) a pair of identical cylindrical body and tray release shafts 80 for releasing lashing of the cylindrical body, the lug 70 of the cylindrical body, and locking the trays 46 and 48 in the down position or releasing therefrom;

(5) forward and aft lashing shafts 82 and 84 for operating forward and after lashing of the dual loading and stowage apparatus 40 to a dolly or a skid shown in phantom at 86 in FIG. 6. Each of the aforementioned control shafts is only a portion of the respective operable means for moving respective components of the dual loading and stowage apparatus 40. The remainder of the elements of each operable means for performing the various functions will be described in detail hereinafter.

CROSS TRAVEL MEANS

One of the operable means is means for driving the strongback 50 and the trays 46 and 48 laterally across the base 44. As illustrated in FIGS. 2, 3, 21, and 32 the lateral driving means may include the shaft 72 rotatably mounted in the base 44 with a pair of spaced apart pinions 88. A pair of racks 90 may be mounted in a spaced apart relationship laterally across the bottom of the strongback 50 in meshing engagement with the respective pinions 88. With this arrangement the rotation of the cross travel shaft 82 will cause the strongback 50 and the trays 46 and 48 to be indexed to desired lateral positions as indicated in FIGS. 23 through 25.

INDEXING MEANS

Figure 16:
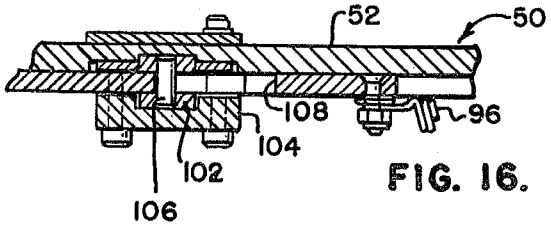
FIG. 16 is a cross-sectional view taken along plane XVI—XVI of FIG. 15.
Figure 22:
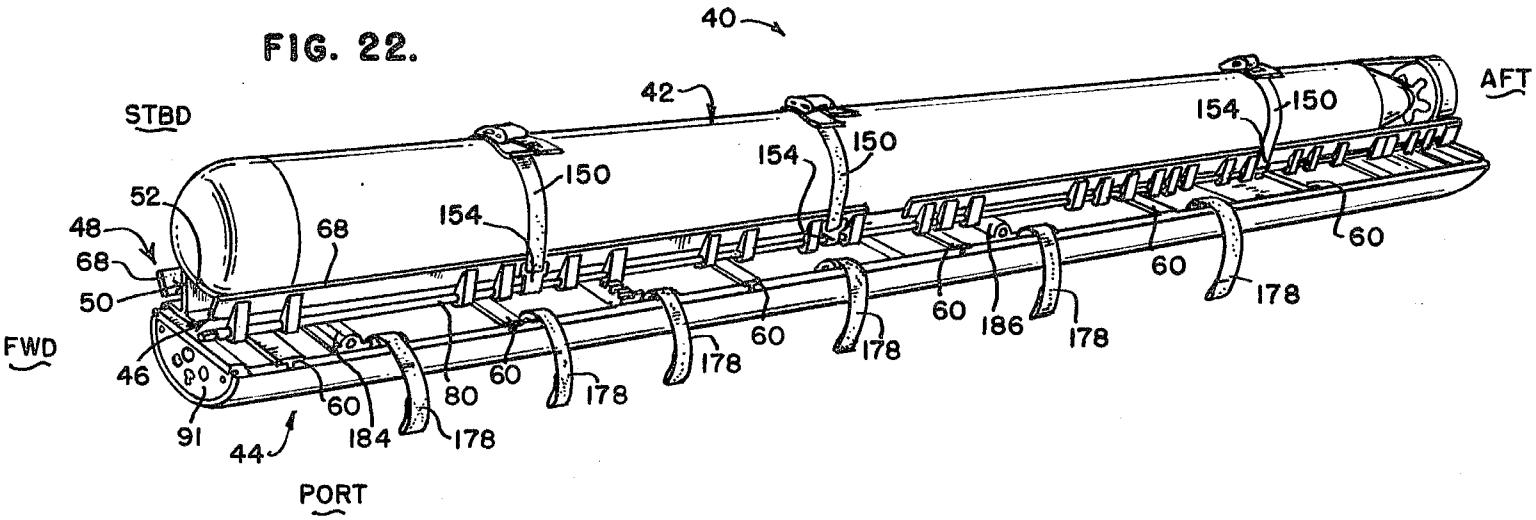
FIG. 22 is an isometric view of the apparatus with one cylindrical body loaded thereon, the cylindrical body being indexed to a loading position.

Another one of the operable means includes lever means for indexing the strongback 50 to the various lateral positions across the base 44, that is to the stow, intermediate stow, and load positions marked on a forward plate 91 of the base 44, as illustrated in FIGS. 1 and 4. Each position is obtained by aligning the vertical member 52 with the appropriate mark. As illustrated in FIGS. 3, 14 through 16, 20 and 32, the indexing means may include the rod 74 which is reciprocably mounted for fore and aft movements on the vertical member 52 by brackets 92. The brackets 92 have enough space therein so that the rod 74 can be pulled slightly up at its controllable end so that the pull knob 76 can be recessed in a notch 94 in the forward end of the vertical member 52 of the mounting means for retention thereof against a spring 96 which is connected between the opposite end of the rod 74 and a side of the strongback vertical member 52. A pair of plates 98 is laterally mounted on the base 44 with laterally spaced notches 100 which correspond to the stow, intermediate stow, and load indexing positions illustrated in FIG. 4. A pin 102 is provided for recess into the notches of each plate 98 so that when the pins 102 are recessed the strongback 50 is prevented from moving laterally on the base 44, however, when the pins 102 are withdrawn from the notches 100, the strongback is free to move laterally thereon. A pin 102 is shown recessed in a respective notch 100 in FIG. 15 and is slidably mounted for vertical motion with respect to the vertical member 52 of the strongback by a bracket 104. Further, the bracket 104 is provided with fore and aft openings for slidably receiving the rod 74 therethrough. The rod 74 is connected to each pin 102 by a smaller transverse pin 106. The transverse pin 106 extends into a curved slot 108 within the rod 74 so that when the bar is pulled against the spring 96 the vertical pin 102 is raised out of the respective notch 100 in the plate 98 so as to allow the strongback or mounting means 50 to be driven laterally across the base 44. Once the indexing bar means 74 has been pulled and the strongback 50 laterally moved somewhat by the cross-travel rod 82, the knob 76 of the bar 74 can be released and the vertical pin 102 will drop automatically into the next notch 100, or if desired, the pull knob 76 may be recessed within the notch 94 to allow the crosstravel shaft 82 to be turned to place the strongback 50 and the corresponding trays 46 and 48 at any desired lateral position along the base 44. As illustrated in FIGS. 16 and 20, each plate 98 may be provided up upwardly extending projections 109 to preclude the strongback assembly 50 from disengaging from either end of the base 44.

TRAY LOCKING MEANS

Figure 8:
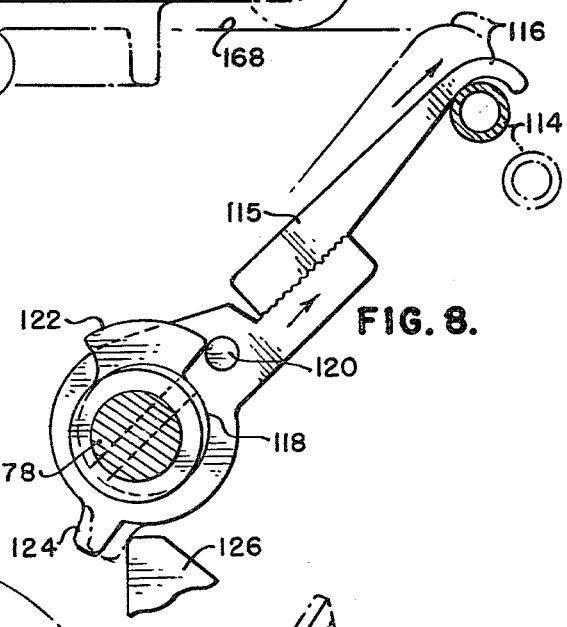
FIG. 8 is an enlarged view of the lever portion of FIG. 7.
Figure 7:
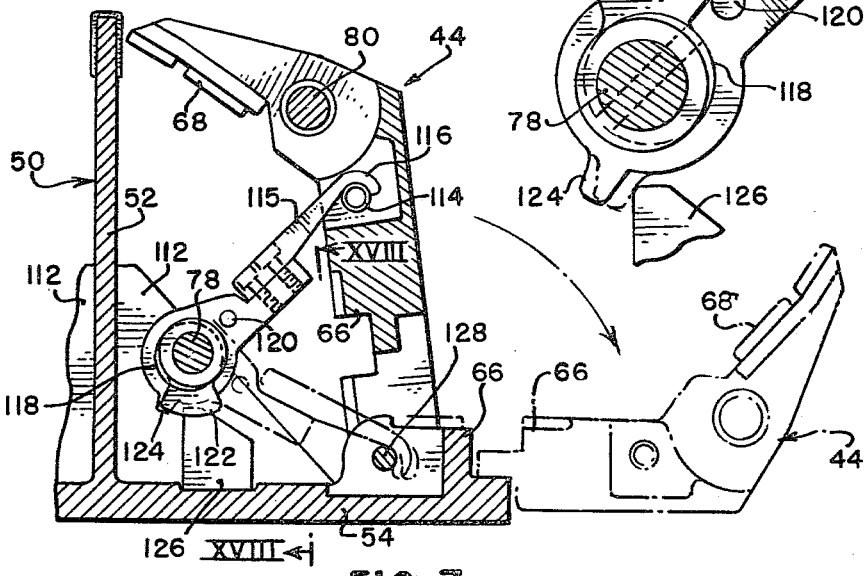
FIG. 7 is a cross-sectional view taken along plane VII—VII of FIG. 2.
Figure 9:
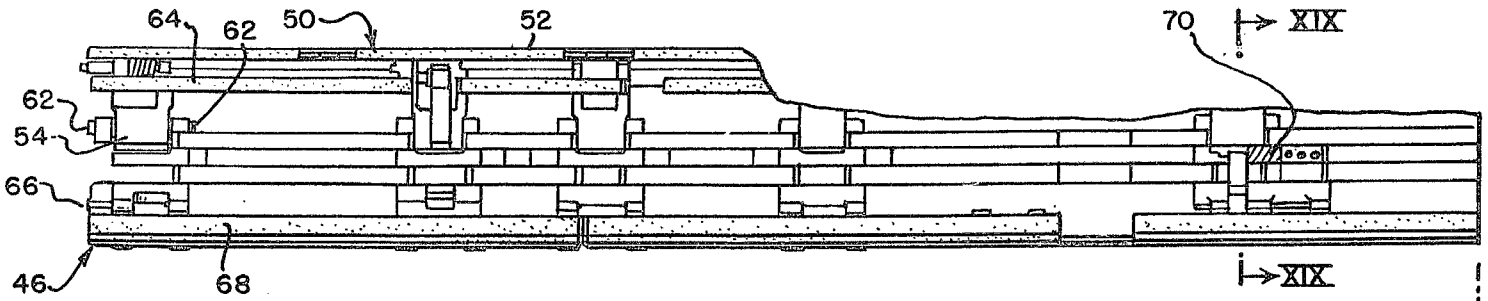
FIG. 9 is a view taken along plane IX—IX. of FIG. 4.
Figure 9:
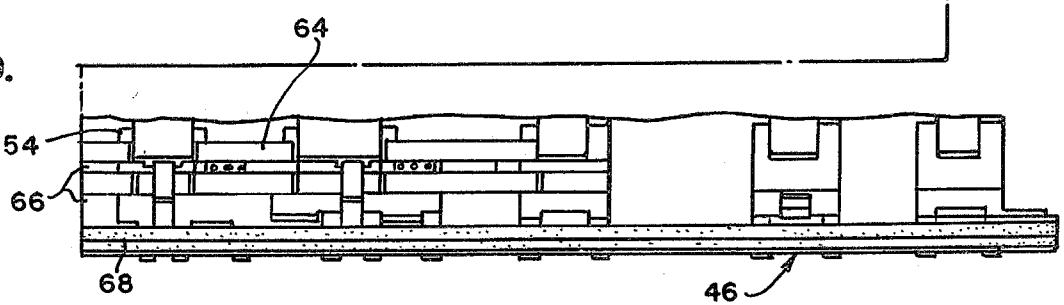
Figure 13:
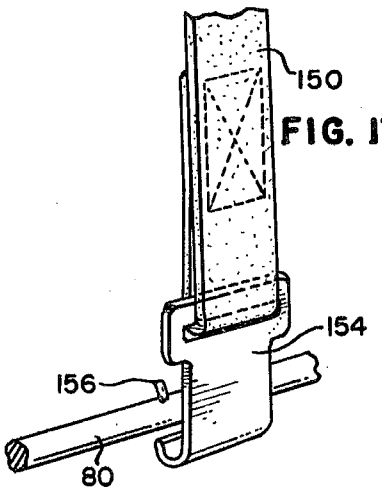
FIGS. 11, 12, and 13 illustrate a shaft for retaining and releasing the strap of FIG. 10.

As illustrated in FIGS. 5, 7, 8, 17, 18, and 32 another one of the separable operable means includes means for locking each respective tray 46 and 48 in its upward position. This tray locking means may include the shafts 78 which are rotatably mounted in the strongback assembly 50 by brackets 110 and 112. Each tray 46 and 48 is provided with a transverse pin 114. An arm 115 is mounted on each shaft 78 and has a hook 116 at its end for engaging a respective pin 114 and retaining the respective tray 46 and 48 in the upward position. An eccentric cam 118 is fixedly mounted on each locking shaft 78, and each arm 115 is slidably rotatably mounted on each respective cam 118. Each arm 115 has a pin 120 which extends transversely thereto. A radially extending stop plate 122 is connected to each cam transversely thereto for engaging each respective arm pin 120 from opposite sides depending upon which direction the respective shaft 78 is rotated so that upon rotating the shaft 78 in one direction the cam stop 122 will engage the arm pin 120 on one side and rotate the arm 115 in a corresponding direction, and yet upon rotating the shaft 78 in an opposite direction in cam stop 122 will engage the arm pin 120 on its other side to rotate the arm 114 in a corresponding opposite direction. As illustrated in FIGS. 7 and 8, the angular position of the cam stop 122 corresponds substantially with the angular position of the high side eccentricity of the cam 118 so that the respective arm 115 is pushed outwardly, as illustrated in FIG. 8, to release the hook 116 from the respective tray pin 114 when the cam stop 122 is in engagement with the arm pin 120 from either side thereof. Further, each arm 115 may be provided with a projection 124 which will engage a stop 126 on the lateral extension 56 of the strongback for limiting the counterclockwise rotation of the arm 115 from the respective tray pin 114. With this arrangement counterclockwise rotation of one of the shafts 78 will cause the cam 118 to push the hook 116 of the arm 115 outwardly and then rotate it counterclockwise until the projection 124 meets the stop 126 to release the tray pin 114 to allow the tray to be pivoted to its downward position as illustrated in phantom in FIG. 7. Once the tray is in the downward position the arm 115 can be rotated downwardly by the shaft 78 to hook into a pin 128 which is mounted on an outward portion of a respective lateral extension 56 of the strongback 50. An unhooking operation from this pin is similar to that described for the pin 114. The unhooking operations and rotation of the respective arm 115 is carried on by operation of the shaft 78, cam 118, cam stop 122, and the arm pin 120.

As illustrated in FIGS. 4 and 17, the controllable end of each tray locking shaft is provided with means for locking rotation of the respective shaft, but yet longitudinally slidable by force of the end of a socket wrench 130 to release the respective shaft 78 and allow the nut thereon to be turned by the socket wrench 130. This may be accomplished by a sleeve 132 which is longitudinally slidable upon each shaft 78 and has a forward end 134 which is splined to mate with the flats of a nut 136 fixed to the end of the shaft 78. A compression spring 138 is mounted between the other end of the sleeve 132 and the shaft support 110 so that the sleeve 132 can be pushed aft to release the nut 136 so as to allow free rotation of the shaft 78. The sleeve 132 is fixed from rotating by a bolt 140 which projects into a longitudinal slot 142 in the side of the sleeve 132. As illustrated in FIG. 5, the bolt 140 may be retained in position by a nut 144 and a bracket 146 which is mounted to a respective lateral extension 54 of the strongback 50. As illustrated in FIG. 17 when the deep socket 130 is inserted on the nut 136 and pushed sufficiently to free the collar 132 from the nut 136, the socket will then be able to turn the shaft 78 for selective locking or unlocking the respective tray 46 or 48 in the upward position, as illustrated in FIG. 7.

CYLINDRICAL BODY AND TRAY RELEASING MEANS

The cylindrical body and tray releasing means serves a triple function, namely: (1) Releasing straps 150 which lash the cylindrical bodies to the strongback 50 and tray assemblies 46 and 48; (2) releasing the lug 70 affixed to the bottom of each cylindrical body between the pair of rails 66 so that the respective cylindrical body can be moved longitudinally along the respective tray 46 or 48; and (3) releasing the trays 46 and 48 from a locked down position. These functions occur substantially simultaneously. The strap releasing components are illustrated in FIGS. 1, 2, 10 through 13, 22, and 32. The lug releasing components are additionally shown in FIGS. 4 and 19.

Figure 12:
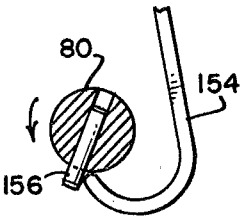
Figure 11:
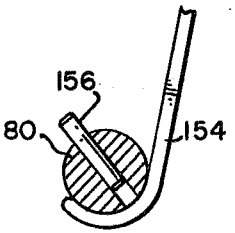
Figure 10:
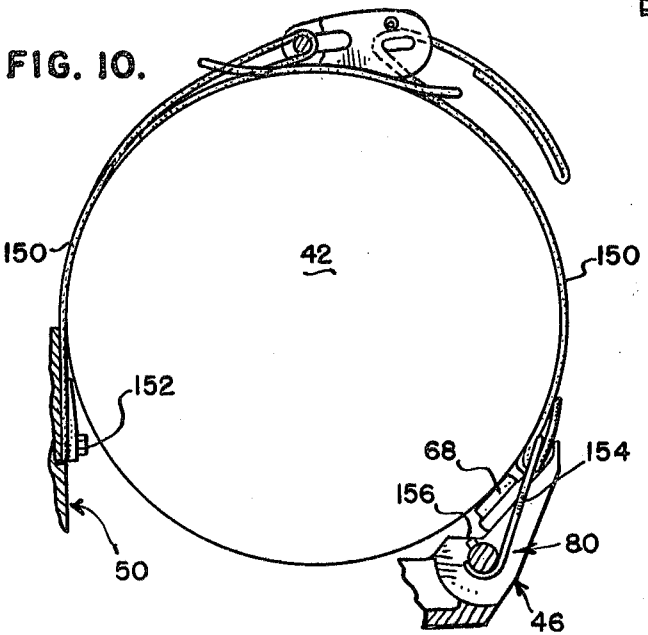
FIG. 10 is a view illustrating a strap lashing the cylindrical body to the apparatus.

The cylindrical body and tray releasing means includes the straps 150 which may be connected at one end to a respective side of the upright portion 52 of the strongback by bolts 152. The other end of each strap 150 has a hook 154 for partially encompassing a respective release shaft 80 so as to hold the cylindrical body to the entire stowage apparatus 40. The release shaft 80 has transverse pins 156 which project from the shaft adjacent the hooks 154 for forcing the hooks away from the release shaft 80 and releasing the straps therefrom when the release shaft is rotated, as illustrated in FIG. 12. With this arrangement, a counterclockwise rotation of either shaft 80 will result in a release of all the respective straps 150 hooked thereto.

As illustrated in FIGS. 4 and 19 the cylindrical body and tray releasing means further includes means mounted on each tray 46 and 48 and each respective release shaft 80 for stopping or releasing movement of the respective lug 70 in the respective slot between the pair of rails 66. The stopping and releasing means may include a plate 158 which is slidably transversely mounted on a respective tray 46 and 48 so as to be projectible in and out of the respective slot for stopping or releasing the lug on the cylindrical body 42. The plate 158 has a notch 160 in its top edge. A pin 162 is mounted parallel to and radially spaced from each respective release shaft 80 for engaging the respective plate in its notch 160 for driving the plate transversely to stop or release the respective body lug 70 when the release shaft 80 is rotated. Each pin 162 may be connected to the respective release shaft 80 by a bell crank 164. The angular locations of the pins 162 and the pins 156 on the release shafts 80 are such that the straps 150 and the lugs 70 are released simultaneously on counterclockwise rotation of either shaft 80 to the detent position within notch 160.

Figure 14:
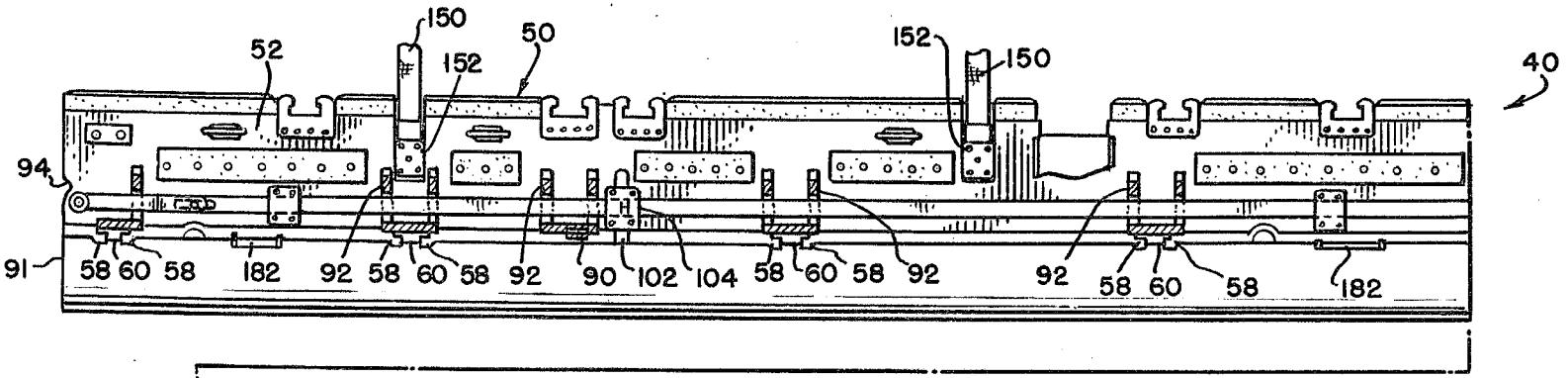
FIG. 14 is a view taken along plane XIV—XIV. of FIG. 4.
Figure 15:
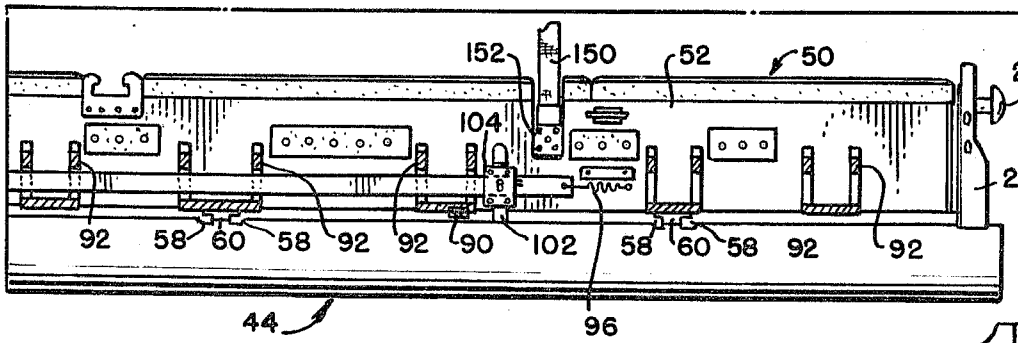
FIG. 15 is a detail of the lateral indexing portion of FIG. 14.
Figure 15:
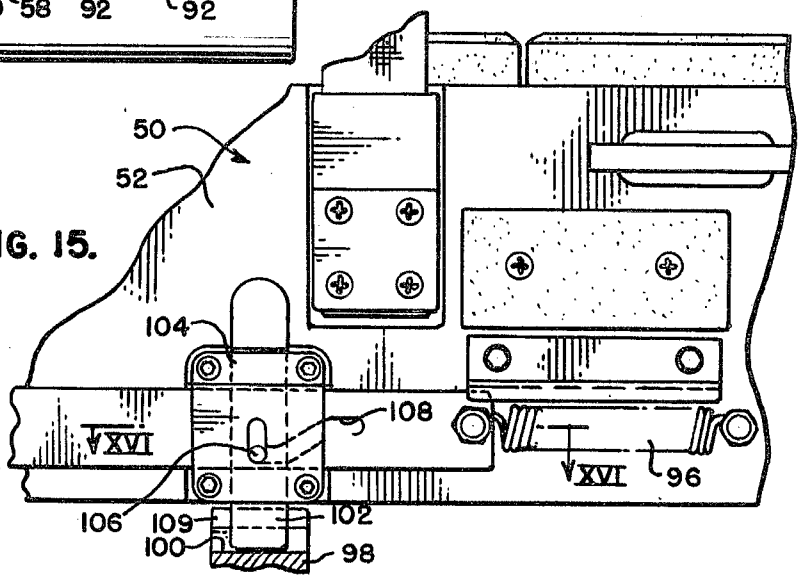

As illustrated in FIG. 19 the cylindrical body and tray releasing means further includes the strongback assembly having an outwardly extending tab 165 in lateral alignment with each plate 158. The plate 158 has an inwardly extending tab 166 which, in an inward position, as shown in FIG. 14, is below the strongback tab 165 to lock the respective tray in the downward position, and, in an outward position, is free of the strongback tab 166 to allow the tray to be rotated upwardly. When the shaft 80 is further rotated from the detent position (pin 162 in the notch 160) the respective tray tab 166 is withdrawn from underneath the respective strongback tab 166 so as to unlock the tray from its downward position.

DUAL LOADING STORAGE APPARATUS LASHING MEANS

The lashing means for retaining the entire storage apparatus with or without the cylindrical bodies 42 to a series of dollies 86 is illustrated in FIGS. 3 through 6 (one dolly being shown) and 32. The dollies 86 may be utilized aboard a submarine for moving the entire apparatus 40 athwartships on submarine tracks 168. This will enable moving the apparatus in the proximity of the submarine's torpedo tubes for loading and eventual discharge of the cylindrical bodies 42. The lashing means may include fore and aft pairs of shafts 170 and 172 respectively which are longitudinally and rotatably mounted in the base 44 by bearings 174. The shafts 170 and 172 may be provided with spools 176 for receiving one end of a series of straps 178, the other end of the straps being connected to anchors 180 on the dollies 86. The anchors 180 are designed for the particular dolly to be utilized. Stainless steel saddles 182 may be affixed to the top longitudinal edges of the base 44 to provide smooth surfaces for the straps 178 to travel thereacross and restrain movement of the base 44. A fore gearbox 184 is transversely mounted on the base 44 for simultaneously operating the pair of shafts 170 in opposite directions, and an after gearbox 186 is transversely mounted on the base 44 for simultaneously operating the pair of shafts 172 in opposite directions. The forward gearbox 184 is operated by the forward lashing shaft 82 and the after gearbox 186 is operated by the after lashing shaft 84. With this arrangement the forward lashing shaft 82 may be turned to either tighten or loosen the respective straps 178 to a forward series of dollies 86, and the after lashing shaft 84 can be turned to either tighten or loosen the respective straps 178 to a series of after located dollies 86.

HANDLING MEANS FOR DUAL LOADING STORAGE APPARATUS

Figure 26:
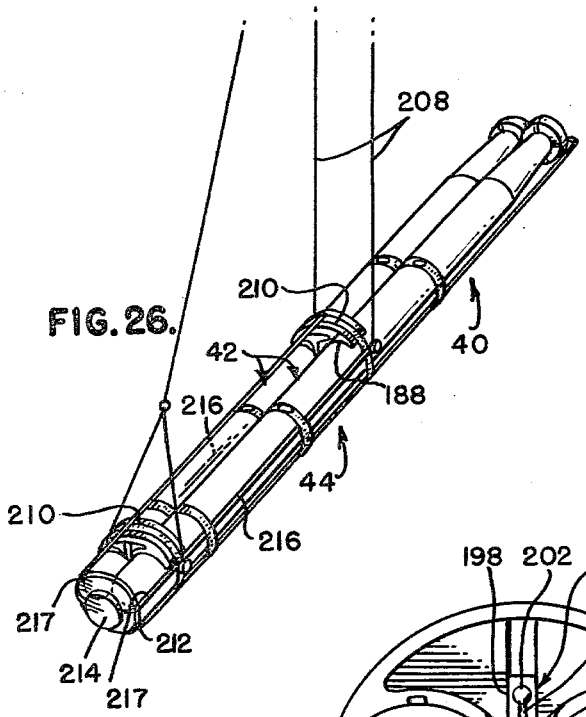
FIG. 26 is an isometric illustrated of a pair of cylindrical bodies in the apparatus and being loaded by lift lines which are connected at their bottom ends to a pair of material handling devices.
Figure 27:
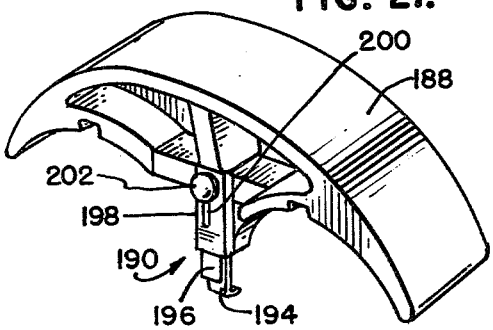
FIG. 27 is isometric illustration of one of the material handling devices.
Figure 29:
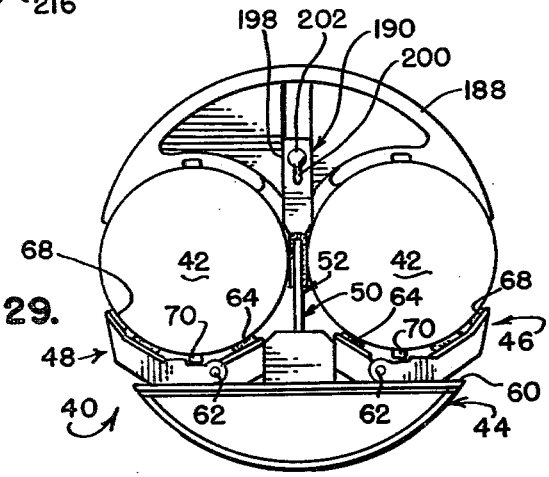
FIG. 29 is an end view of the pair of cylindrical bodies on the apparatus with the material handling device connected in place.
Figure 28:
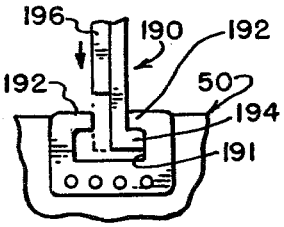
FIG.28 is a side illustration of a detail of a portion of the latching apparatus of the material handling device latched into the top edge of the strongback.
Figure 30:
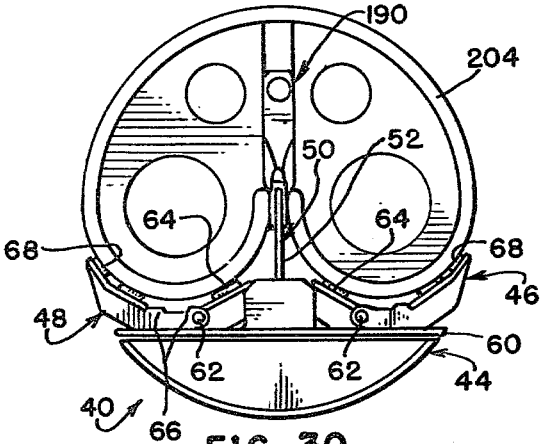
FIG. 30 is a schematic illustration of another embodiment of a material handling apparatus connected to the dual loading and stowage apparatus without either of the pair of cylindrical bodies.
Figure 31:
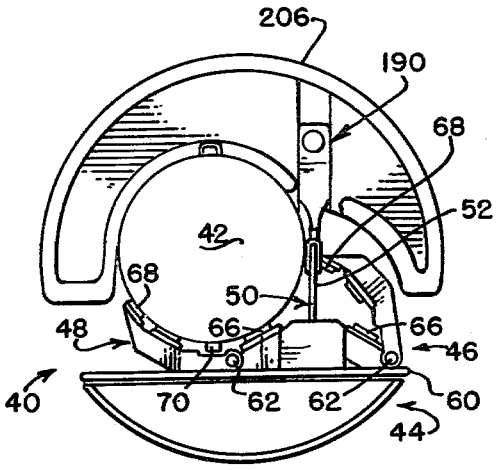
FIG. 31 is a schematic illustration of still another material loading device connected to the dual loading and stowage apparatus when only one of the cylindrical bodies is in place.
Figure 32:
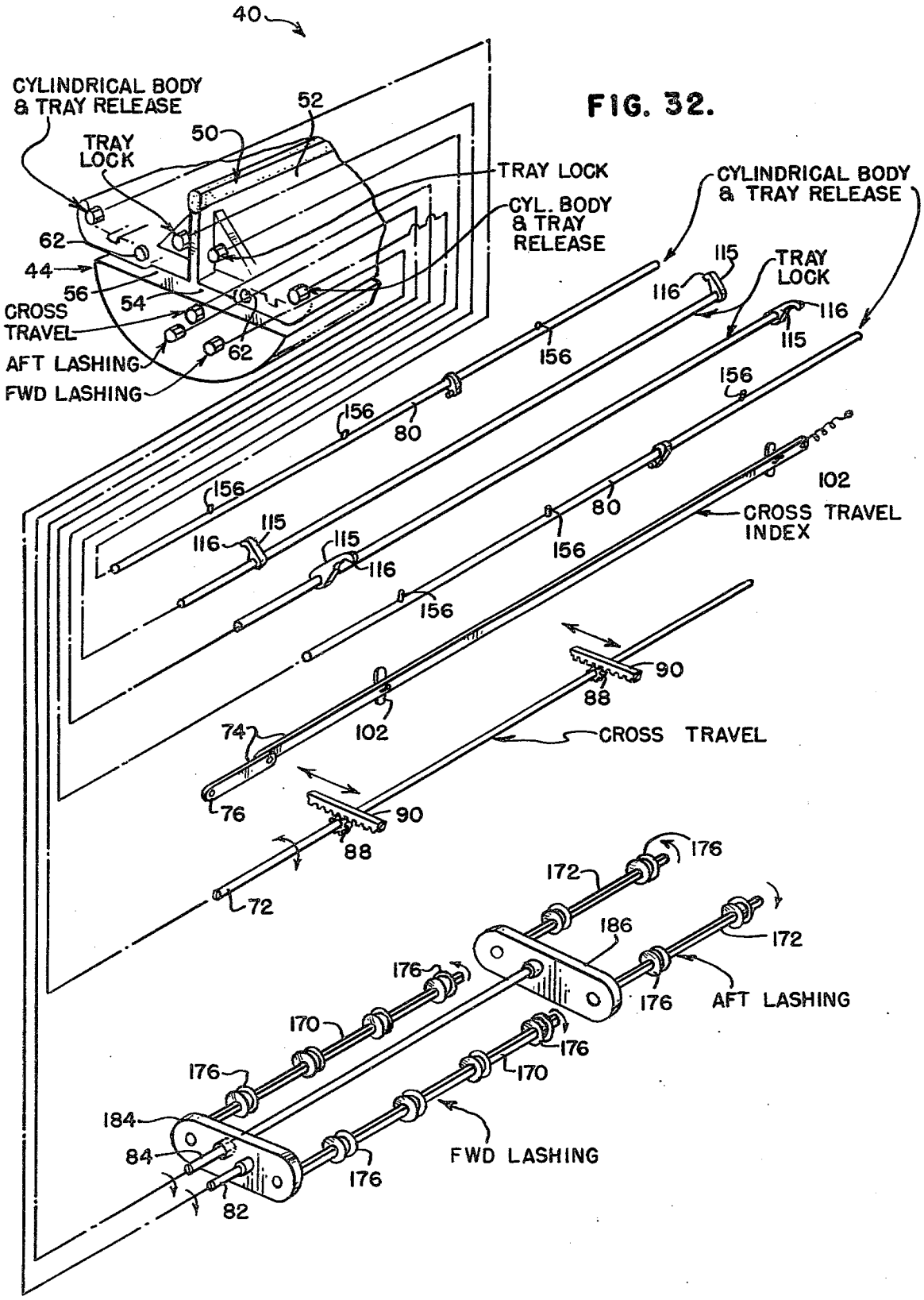
FIG. 32 is a schematic illustration of all of the various lever and shaft controls for operating the various components of the dual loading and stowage apparatus.

The handling means for the dual loading storage apparatus 40 with or without the cylindrical bodies 42 are illustrated in FIGS. 2 and 26 through 31. Three embodiments of the handling means are illustrated in FIGS. 29, 30, and 31, respectively. As illustrated in FIG. 27, the handling means may include a cap 188 which conforms at its bottom to the shape of a pair of the cylindrical bodies 42 and which has a centrally located catch 190. As illustrated in FIG. 2, the top edge of the vertical member 52 of the strongback may be provided with a plurality of notches 191 for receiving and retaining the various catches 190. Each of the notches 191 is provided with a pair of inwardly extending edges 192, and the catch 190 may be provided with a hook 194 which can be caught below one of the notched edges 192. The catch 190 further has a slidable plate 196 which can be reciprocated between up and down positions so that in the down position it can wedge the hooked end 194 in a respective notch 190, as illustrated in FIG. 28. The catch 190 may be provided with a housing 198 for the slidable plate 196 with a vertical slot 200 so that a knob 202 attached to the slidable plate 196 may be manually operated to perform the up and down movements thereof. As illustrated in FIG. 30, another embodiment of the handling means may include a cap 204 which conforms to the top of the dual loading storage apparatus 40 when both of the cylindrical bodies are removed therefrom. Still another embodiment of the handling means is a cap 206 which conforms to the top of one of these cylindrical bodies 42 and the remainder of the dual loading and storage apparatus 40 when one of the cylindrical bodies is loaded thereon and the other cylindrical body is removed therefrom. All embodiments of the handling means may utilize the catch means 190 for retention to the vertical member 52 of the strongback.

As illustrated in FIG. 26, lift lines 208 may be utilized for transporting the dual loading and storage apparatus 40 with a pair of the cylindrical bodies 42 mounted thereon. In this embodiment a pair of the caps 188 may be mounted as described hereinabove. Each cap may be surrounded by a respective strap 210, and a plate 212 with a bull nose 214 may be mounted at the forward end of the entire apparatus. A pair of cables 216 may extend longitudinally to interconnect the straps 210 and the plate 212, and the lift lines 208 may be pivotably connected at these interconnections or for transporting the entire apparatus. Additional straps 217 may interconnect the bullnose 214 to the forward circumferential strap 210. With this arrangement, the lift lines may be utilized to lower the entire apparatus with the cylindrical bodies 42 into the hold of a submarine, after which the internal gear of the submarine may be utilized for placing the entire apparatus within the torpedo room thereof. The same operation may be employed in utilizing the caps 204 or 206 for handling purposes.

MISCELLANEOUS

As illustrated in FIG. 2, a vertically extending handle 218 with a horizontally extending knob 220 may be provided at the aft end of the base 44 for manipulating the entire stowage apparatus 40 in a longitudinal direction. Powered submarine gear may be utilized for performing this function when the entire apparatus is released from a series of skids by the lashing means described hereinabove.

OPERATION OF THE INVENTION

The entire dual loading and stowage apparatus 40 with a pair of the cylindrical bodies 42 may be loaded into a submarine by the handling means illustrated in FIG. 26, after which internal submarine gear will place the apparatus into stowage within the submarine's torpedo room. As illustrated in FIG. 6 the apparatus may be lashed to dollies 166 (one being illustrated in the figure) for moving the entire apparatus from a stowage position to alignment of the vertical member 52 of the apparatus with a torpedo tube of the submarine. When it is desired to load one of the cylindrical bodies into the torpedo tube the indexing lever 74 may be pulled and the crosstravel shaft 82 may be turned until the vertical member 52 is aligned above one of the load positions, depending upon which cylindrical body is to be loaded into the torpedo tube. The indexing lever 74 is then released so as to lock the vertical member 52 in its load position. The respective release shaft 80 is then turned so as to release the straps 150 and release the lug 70 at the bottom of the cylindrical body 42. Internal submarine gear is then utilized to push the cylindrical body 42 into the torpedo tube. This loading position is illustrated in FIG. 24 of the drawings. After off-loading one of the cylindrical bodies the indexing bar 74 is once again pulled so as to release cross travel and the cross travel shaft 82 is rotated until the vertical member 52 is aligned with the intermediate stowage position, as illustrated in FIG. 25. The release shaft 80 is then further rotated to release the off-loaded tray from its downward position.

The off-loaded tray is then pivoted to its upward position and the entire apparatus can remain for off-loading of the remaining cylindrical body at some future time with a minimum of space being taken thereby. As illustrated in FIGS. 1 and 7 the appropriate tray locking shaft may be turned to lock the tray 46 or 48 in the upward position.

It is now readily apparent that the present invention provides a unique solution to stowage, handling, and off-loading of a pair of cylindrical bodies, while maintaining a minimim of space imposition on the critical requirements of a compartment, such as a torpedo room. Rather than requiring many different types of gear to accomplish these functions the present invention provides a single apparatus for accomplishing the entire operation. Further, rather than requiring three or four people to operate, the present invention can be operated by only one person utilizing the various controls at the forward end of the apparatus. A great deal of time is saved and the previous hazards to personnel have been obviated.

Obviously, many modifications and variations of the present invention are possible in light of the above teachings, and, it is therefore understood that the invention may be practiced otherwise than as specifically described.

What is claimed is:

1. An apparatus for handling, stowing, and off loading a pair of cylindrical bodies comprising:

an elongated base;

a pair of elongated trays positioned side by side above the base and parallel thereto for receiving the cylindrical bodies;

means slidably mounting the trays for lateral movement on the base so that each tray can be selectively centered above the base for off loading purposes;

each of said trays being pivoted to the mounting means along an inner edge of each respective tray so as to be capable of pivoting between downward and upward positions; and the lateral dimension of the pair of trays in their downward positions being greater than the lateral dimension of the base, but when one of the trays is pivoted to its upward position the lateral dimension of the trays being less than the lateral dimension of the base;

whereby after unloading one of the cylindrical bodies from the apparatus, the unloaded tray can be pivoted upwardly and the loaded tray can be moved inwardly until the lateral space taken by the apparatus is minimized.

2. An apparatus as claimed in claim 1 including:

the mounting means being an elongated strongback which is located parallel to and between the trays; and the strongback and trays forming a pair of cradles for receiving the cylindrical bodies.

3. An apparatus as claimed in claim 2 including:

the trays and the strongback being formed by a plurality of rails; and each of the trays having a pair of bottom rails which are spaced to provide a guide for a bottom lug on a respective cylindrical body.

4. An apparatus as claimed in claim 1 including:

the apparatus having fore and aft ends;

a plurality of separate operable means for moving respective components of the apparatus; and said operable means substantially terminating in controllable ends at a common transverse plane which is substantially coextensive with the fore end of the apparatus.

5. An apparatus as claimed in claim 4 including:

said operable means comprising shafts which extend parallel to the base and trays;

each of said shafts terminating at said common transverse plane to provide said controllable ends; and each controllable end being configured in a nut for turning by a socket wrench.

6. An apparatus as claimed in claim 5 including:

the mounting means being an elongated strongback which is parallel to and located between the trays; and the strongback and trays forming a pair of cradles for receiving the cylindrical bodies.

7. An apparatus as claimed in claim 6 including:

the trays and the strongback being formed by a plurality of rails; and each of the trays having a pair of bottom rails which are spaced to provide a guide for a bottom lug on a respective cylindrical body.

8. An apparatus as claimed in claim 4 including:

one of the operable means being means for driving the mounting means laterally across the base; and another one of the operable means being lever means for indexing the mounting means at various positions across the base.

9. An apparatus as claimed in claim 8 including:

the mounting means being a strongback which has an elongated upright member which is parallel to and located between the trays;

said various indexing positions across the base being a center stow position, a load position laterally spaced on each side of the center stow position, and an intermediate stow position between each load position and the center stow position;

the outer lateral edge of the respective tray substantially meeting the top edge of the upright member of the strongback when the tray is pivoted to its upward position; and the apparatus taking up a minimum of lateral space when the strongback is in an intermediate position and one of the trays is folded to its upward position.

10. An apparatus as claimed in claim 9 including:

one of the separable operable means being means for locking each respective tray in its upward position; and each tray lock means including a tray locking shaft slidably rotatably mounted on the strongback, one end of the shaft terminating in a controllable end at the common transverse plane;

each tray having a transverse pin; and an arm transversely mounted on each shaft and having a hook at its end for engaging a respective pin and retaining the respective tray in the upward position.

11. An apparatus as claimed in claim 10 including:

an eccentric cam fixedly mounted on each locking shaft;

each arm being slidably rotatably mounted on each respective eccentric cam;

each arm having a transversely projecting pin;

a radially extending stop transversely connected to the cam for engaging each respective arm pin from opposite sides depending upon which direction the locking shaft is rotated so that upon rotating the locking shaft in one direction the cam stop will engage the arm pin on one side and rotate the arm in a corresponding direction, and upon rotating the locking shaft in an opposite direction the cam stop will engage the arm pin on its other side to rotate the arm in a corresponding opposite direction; and the angular position of the cam stop corresponding substantially with the angular position of the high side eccentricity of the cam so that the respective arm is pushed outwardly to release the hook from the respective tray pin when the cam stop is in engagement with the arm pin from either side thereof.

12. An apparatus as claimed in claim 11 including:

the controllable end of each of the tray locking shafts terminating in a nut which can be turned by a socket wrench; and means at each controllable end of the tray locking shafts for locking rotation of the respective shaft, but yet longitudinally slidable by force of the socket and to release the shaft and allow the nut and the respective shaft to be turned by the socket wrench.

13. An apparatus as claimed in claim 9 wherein the driving means includes:

a rack laterally mounted across the bottom of the strongback;

a shaft and pinion mounted on the base for operating the rack; and said shaft terminating in said controllable end at the common transverse plane.

14. An apparatus as claim in claim 9 wherein the indexing means includes:

a plate transversely mounted on the base with top edge spaced apart depressions which correspond to the center stow, load, and intermediate stow positions;

a pin which is adapted to recess into the plate depressions;

a spring biased bar slidably mounted on the strongback and having a curved slot;

a second pin extending transversely from the first mentioned pin and slidably extending into the said curved slot so than when the bar is pulled against the spring force the first mentioned pin is raised out of a respective plate depression to allow the strongback to be driven laterally; and the bar terminating in one of said controllable ends at the common transverse plane.

15. An apparatus as claimed in claim 14 wherein the driving means includes:

a rack laterally mounted across the bottom of the strongback;

a shaft and pinion mounted on the base for operating the rack;

said shaft terminating in said controllable end at the common transverse plane, and

16. An apparatus as claimed in claim 15 including:

one of the separable operable means being means for locking each respective tray in its upward position; and each tray lock means including a tray locking shaft slidably rotatably mounted on the strongback, one end of the shaft terminating in a controllable end at the common transverse plane;

each tray having a transverse pin; and an arm transversely mounted on each shaft and having a hook at its end for engaging a respective pin and retaining the respective tray in the upward position.

17. An apparatus as claimed in claim 16 including:

the controllable end of each of the tray locking shafts terminating in a nut which can be turned by a socket wrench; and means at each controllable end of the tray locking shafts for locking rotation of the respective shafts, but yet longitudinally slidable by force of the socket and to release the shaft and allow the nut and the respective shaft to be turned by the socket wrench.

18. An apparatus as claimed in claim 4 including:

straps fixed at one of their ends to the mounting means for lashing the cylindrical bodies to the trays;

a cylindrical body release shaft slidably rotatably mounted along each respective tray;

the other end of each strap having a hook for partially encompassing a respective release shaft to hold the strap about the cylindrical body; and transverse pins projecting from the shaft adjacent the hooks for forcing the hooks away from the release shaft and releasing the straps when the release shaft is rotated; and said release shaft terminating in one of said controllable ends at said common transverse plane.

19. An apparatus as claimed in claim 18 including:

each tray having a longitudinal bottom located slot for receiving and guiding a lug on the cylindrical body along the respective tray; and means mounted on each tray and respective release shaft for stopping or releasing movement of the respective lug in the respective slot; and the release of the lug of a respective cylindrical body occurring substantially simultaneously with the release of a strap from the cylindrical body.

20. An apparatus as claimed in claim 19 wherein the stopping or releasing means includes:

a plate slidably transversely mounted on a respective tray so as to be projectable in and out of the respective slot for stopping or releasing the body lug respectively;

each plate having a notch in its top edge;

a pin mounted parallel to and radially spaced from each respective release shaft for engaging the respective plate in its notch and for driving the plate transversely to stop or release the respective body lug when the respective release shaft is rotated.

21. An apparatus as claimed in claim 20 wherein the stopping or releasing means further includes:

the mounting means having an outwardly extending tab in lateral alignment with each plate; and each plate having an inwardly extending tab which slides underneath the mounting means tab to lock the respective tray in the downward position and which slides away from the mounting means tab to release the tray to be rotated to the upward position as the plate is slid inwardly and outwardly respectively.

22. An apparatus as claimed in claim 4 including:

a plurality of lashing shafts longitudinally and rotatably mounted in the base; and a plurality of straps wrapped at one of their ends about the respective shafts and adapted at their opposite ends to hook on a skid or dolly so that the straps can be wrapped tightly on the respective shafts to lash the apparatus to the skids or dollies.

23. An apparatus as claimed in claim 21 including:

fore and aft gear boxes;

a pair of forward located lashing shafts connected to the fore gear box;

a first driving shaft also connected to the fore gear box for simultaneously driving the forward locating pair of lashing shafts;

a pair of aft located lashing shafts connected to the aft gear box;

a second driving shaft also connected to the aft gear box for simultaneously driving the aft located lashing shafts; and the first and second driving shafts having ends which terminate in controllable ends at said common transverse plane.

24. An apparatus as claimed in claim 1 including:

the mounting means being a strongback which has an elongated vertical member which is located between the trays;

handling means which conforms to the shape of a cylindrical body and which has a catch; and the top edge of the vertical member having a plurality of notches for receiving and retaining the catch of the handling means.

25. An apparatus as claimed in claim 24 including:

each of the notches having inwardly extending edges;

the catch having a hooked end which can be caught below one of the notch edges; and the catch having slidable means for wedging the hooked end in a respective notch.

26. An apparatus as claimed in claim 24 including:

the handling means conforming to the shape of a pair of the cylindrical bodies and which has the catch located centrally therebetween.

27. An apparatus as claimed in claim 24 including:

the handling means conforming to the shape of only one of the cylindrical bodies and which has the catch located to one side thereof.

* * * * *